US005351442A

United States Patent [19]

Gingras

[11] Patent Number: 5,351,442

[45] Date of Patent: Oct. 4, 1994

[54] DOOR CLOSURE FOR REFRIGERATION HOUSING

[76] Inventor: Jean-Pierre Gingras, 1693 Marie-Dubois, Carignan, Quebec, Canada, J3L 3P9

[21] Appl. No.: 936,216

[22] Filed: Aug. 27, 1992

[51] Int. Cl.[5] ..... B24C 3/37

[52] U.S. Cl. ..... 49/411

[58] Field of Search ..... 49/128, 404, 409, 410, 49/411, 417, 419, 420, 425, 485, 453; 52/211, 212

[56] References Cited

U.S. PATENT DOCUMENTS

| | | | |
|---|---|---|---|
| 1,480,087 | 1/1924 | McClintock | 49/417 X |
| 1,560,930 | 11/1925 | Wright | 49/417 X |
| 2,774,999 | 12/1956 | Mansmann | 49/501 |
| 2,858,408 | 10/1958 | Barroero | 49/410 X |
| 3,079,650 | 3/1963 | Spence | 49/409 X |
| 3,611,637 | 10/1971 | Saino | 49/410 X |
| 4,115,953 | 9/1978 | Brosenius | 49/409 X |
| 4,404,770 | 9/1983 | Markus | 49/409 X |
| 4,476,652 | 10/1984 | Beauchot . | |
| 4,489,517 | 12/1984 | Young | 49/504 X |
| 4,513,554 | 4/1985 | Johnson et al. | 49/501 X |
| 4,561,210 | 12/1985 | Kvas et al. | 49/410 X |
| 4,619,075 | 10/1986 | Wiles | 49/410 X |
| 4,639,970 | 2/1987 | Adams | 49/425 X |
| 4,651,469 | 3/1987 | Ngian et al. | 49/409 X |
| 4,680,828 | 7/1987 | Cook et al. . | |
| 4,854,621 | 8/1989 | Brown | 49/504 X |
| 4,937,978 | 7/1990 | Johansson et al. | 49/501 X |
| 5,214,878 | 6/1993 | Watt | 49/501 X |

FOREIGN PATENT DOCUMENTS

| | | | |
|---|---|---|---|
| 0108778 | 4/1990 | Japan | 49/410 |

*Primary Examiner*—Peter M. Cuomo
*Assistant Examiner*—Jerry Redman
*Attorney, Agent, or Firm*—Longacre & White

[57] ABSTRACT

A slidable door for a refrigeration housing is disclosed and wherein the door is displaceable on a top support rail from a closed position over a door opening to an open position to one side of the door opening. The slidable door comprises a rectangular door panel slidably supported in a top edge thereof for displaceable support engagement with the top support rail. A guide channel is provided in a lower edge of the door panel. Spaced apart bearing posts are secured at predetermined locations in a floor adjacent the door opening, and disposed for engagement by the guide rails. The guide rail has door urging ends to displace the door panel towards the frame of the door opening to close the door opening. The top support rail is a straight rail secured at an angle with respect to the plane of the frame so that when the door panel is over the door opening it closes the opening, and when displaced to the open position, it is positioned outwardly of the plane by the supports in the top edge of the door panel and the guide rails in the lower edge thereof. A novel door frame is also disclosed.

15 Claims, 5 Drawing Sheets

DOOR CLOSURE FOR REFRIGERATION HOUSING

TECHNICAL FIELD

The present invention relates to a slidable door for closing a door opening of a refrigeration housing and to a novel door opening frame structure for such housings.

BACKGROUND ART

Slidable doors which are suspended for displacement on top support rails in order to close a door opening of a refrigeration housing are known, such as disclosed in U.S. Pat. Nos. 4,476,652 and 4,680,828, as examples thereof. In such known designs the door is displaced to seal about a door opening frame. A displaceable support mechanism is usually provided between the top edge of the door and the horizontal support rail to cause the door to move against the door opening. Also, the bottom of the door is usually guided by rollers or other type of guide assemblies secured to the floor, such as disclosed in the above-referenced prior art patents. As disclosed in such prior art, the top support mechanism is somewhat complex and periodically requires repair and adjustment which is difficult due to their construction and location inside the top rail with the load of the door being applied thereto. Also, some of the guide mechanisms in the bottom edge of the door are sometimes difficult to engage with the bottom of the door which is displaced out of engagement thereof.

SUMMARY OF INVENTION

It is a feature of the present invention to provide an improved slidable door for closing the door opening of a refrigeration housing and which substantially overcomes the above-mentioned disadvantages of the prior art.

Another feature of the present invention is to provide a slidable door which utilizes a conventional top rail support that is angulated, and wherein the door is guided from a closed to an open position by a guide channel provided in the door lower edge and engageable with guide posts mounted in a floor surface adjacent the door opening.

Another feature of the present invention is to provide an improved reinforced door frame for a door opening of a refrigeration housing.

According to the above features, from a broad aspect, the present invention provides a slidable door which is displaceable on a top support rail from a closed position over a door opening to an open position to one side of the door opening. The slidable door comprises a rectangular door panel having door support means in a top edge thereof for displaceable support engagement with the top support rail. Guide means is provided in a lower edge of a door panel. Spaced bearing means is secured at predetermined locations in adjacent a bottom edge of the door opening and disposed for engagement by the guide means. The guide means has door urging means to displace the door panel against the frame of the door opening to close the door opening. The top support rail is a straight rail secured at an angle with respect to the plane of the frame so that when the door panel is displaced to the open position, it is positioned outwardly of the plane by the rail support means in a top edge thereof and the guide means in a lower edge thereof.

According to a still further broad aspect of the present invention there is provided a reinforced door frame for a door opening of a refrigeration housing. The door frame comprises an L-shaped metal extruded angle member secured to the reinforced vertical side edges of a door opening provided in a side wall of the housing. A reinforcing top door panel is secured between the opposed L-shaped metal extruded angle members in a top section thereof. A non-bearing extruded angle member is secured to a lower side and frontal edge section of the top door panel. The top door panel and side wall of the door opening have reinforcement means in connecting side edges thereof for receiving fasteners securing the extruded angle member extending on the opposed side edges of the door opening. The top door panel reinforces the opposed vertical L-shaped metal extruded members.

BRIEF DESCRIPTION OF DRAWINGS

A preferred embodiment of the invention will now be described with reference to the accompanying drawings in which.

DESCRIPTION OF PREFERRED EMBODIMENTS

Figure 1:
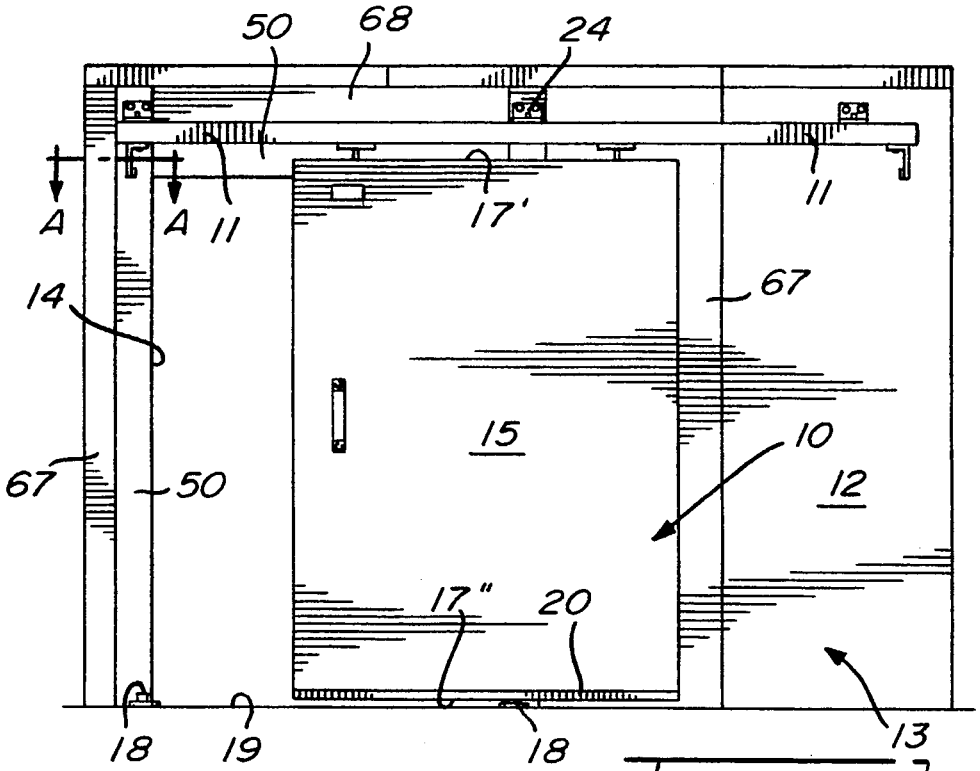
FIG. 1 is a front view of the slidable door panel of the present invention for closing a door opening of a refrigeration housing.
Figure 2:
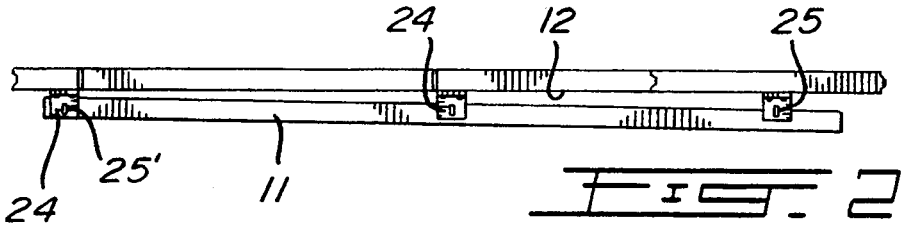
FIG. 2 is a top view showing the securement of the support rail of FIG. 1 with respect to the door opening of the refrigeration housing.

Referring now to the drawings, and more particularly to FIGS. 1 and 2, there is shown generally at 10 the slidable door assembly of the present invention which is displaceable on a top support rail 11 secured to the front wall 12 of a refrigeration housing 13. The door 10 is displaceable from a closed position over a door opening 14 to an open position to one side of the door opening. The slidable door 10 comprises a rectangular door panel 15 having door support means in the form of roller bearing suspension mechanisms 16 secured to a top edge 17' of the door panel and guidingly displaced within the top support rail 11. Guide means in the form of guide bearings 18 are secured at predetermined locations in the floor 19 and adjacent the door opening 14. These guide bearings 19 are received within a guide channel 20 secured in the bottom edge 17'' of the door panel 17.

Figure 3:
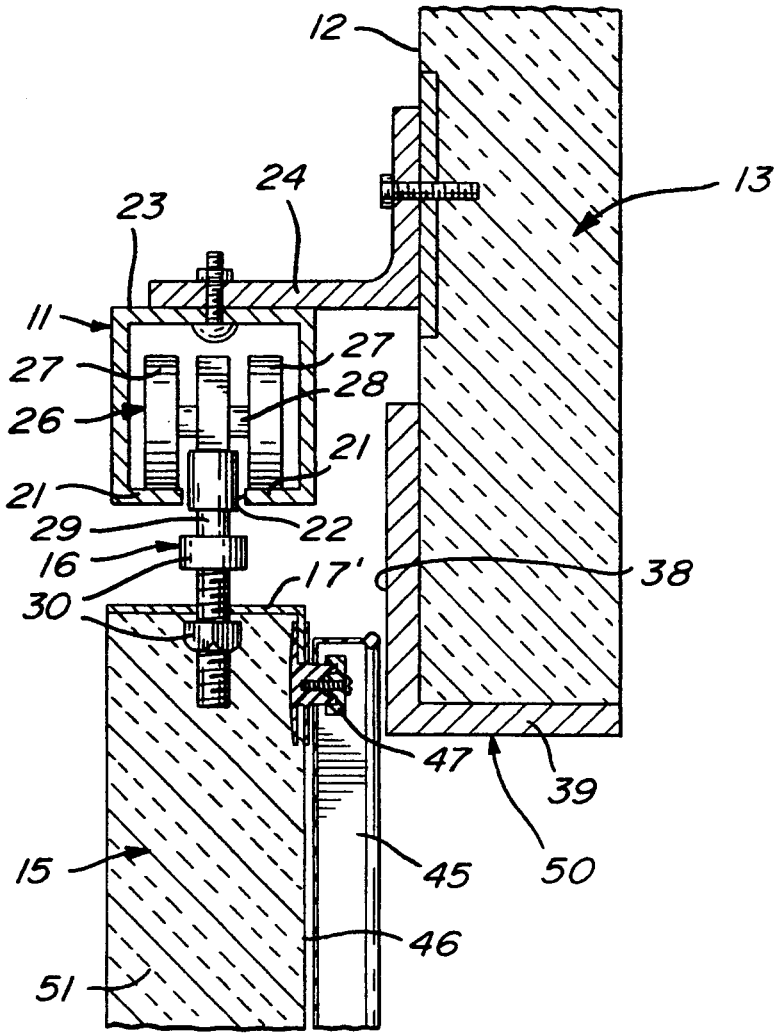
FIG. 3 is a fragmented sectional view showing the construction of the slidable door of the present invention.
Figure 3:
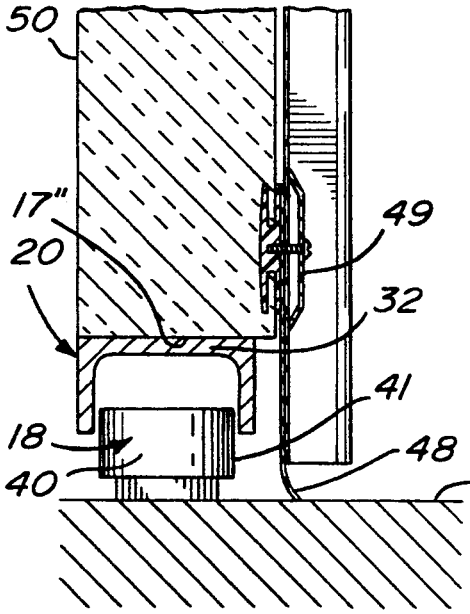

Referring now additionally to FIGS. 3 to 7, there will be described the detailed construction of the support and functioning of the slidable door 10 and its assembly. As shown in FIG. 3 the top support rail 11 is an inverted U-shaped track having a pair of horizontal spaced apart wheel support flanges 21 with an elongated opening 22 provided therebetween. The top wall 23 of the support rail 11 is secured to an L-shaped bracket 24 which is attached to the front wall 12 of the refrigeration housing 13. As illustrated in FIG. 2, the brackets 24 have elongated slots 25 therein to provide for the angular adjustment of the rail 11 with respect to the front wall 12 of the housing. The rail 11 is secured to bracket 25' adjacent the door opening 14 in a closely spaced manner and extends outwardly of the front wall 12 so that as the door panel 15 is moved away from the door opening 14, as it is displaced further away from the door opening of the housing.

In FIG. 3 the roller bearing suspension mechanism 16 consists of a carriage assembly 26 comprising two pairs of wheels 27 supported on an axle 28 to which is secured a support rod 29 threaded at an end 30 for securement to the top edge 17' of the door panel 15 by means of threaded nuts 30. These nuts provide for vertical adjustability of the door panel 15 in a manner well known in the art.

The guide channel 20 is constituted by a U-shaped extruded member, herein an aluminum extrusion piece, having opposed downwardly extending side walls 31 and a connecting wall 32, the latter being secured to the bottom edge 17'' of the rectangular door panel 15 by fasteners. As shown more clearly in FIG. 4, the guide channel 20 has an inlet end 33 for receiving the guide roller bearings 18 therein as the door is displaced from an open position to a closed position. At the inlet end 33 of the channel 20, an inner one of the side walls or guide walls 31' is outwardly angulated at the end section 34 which extends towards the door opening 14 to guide within the guide channel and between the side walls 31 thereof a first one of the guide bearings 18, namely bearing 18'. This angulated end section 34 causes the door panel to move inwardly towards the door opening 31. This displacement is illustrated by the position of the door panel at phantom lines 35 at its open position, and in phantom lines 36 at its closed position. As the first guide bearing 18 is received within the channel 20, the door panel is still at an angulated position supported by the angulated top rail, and until the angulated section 37 at the opposed ends of the channel 20 formed in the outer side wall or guide wall 31'' engages the first roller bearing 18'. At that point the angulated end section 34 of the inner side wall 31' is receiving the second roller bearing 18''. This angulated wall 37 pushes the trailing edge of the door towards the door opening 14 and aligns the door substantially parallel to the outer plane 38 of the door frame 39 and compresses the seal 45 secured to the door.

Figure 7:
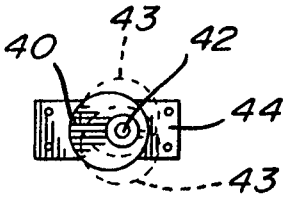
FIG. 7 is a top view of a guide post showing the adjustability thereof.
Figure 11A:
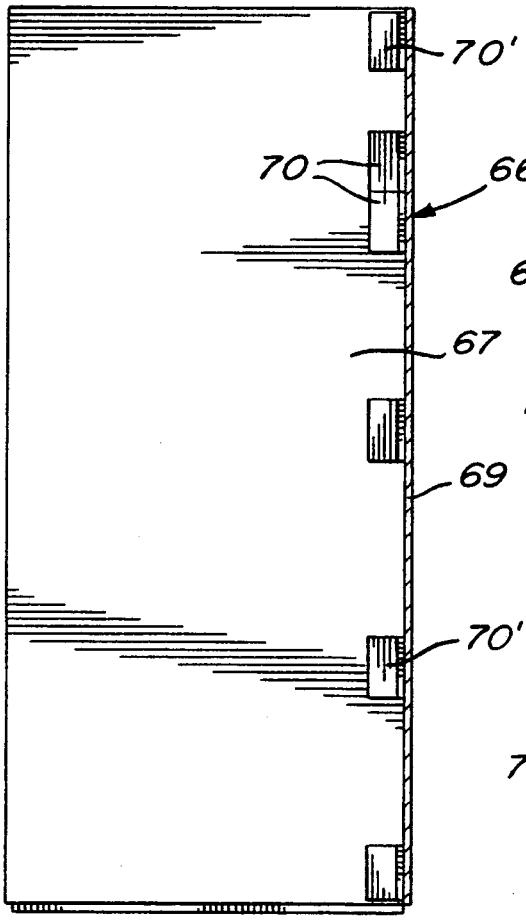
FIGS. 11A and 11B are fragmented side views showing the construction and disposition of the reinforcing members used in the side edges of the door opening and the top door panel member.
Figure 11B:
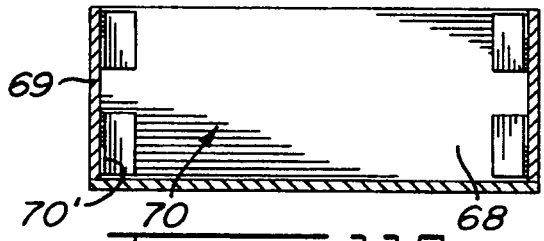
Figure 11C:
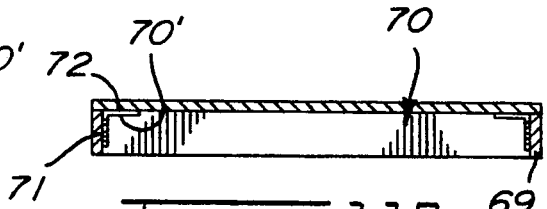
FIG. 11C is a top view of FIG. 11B.

Referring to FIGS. 3 and 7 it can be seen that the guide bearings 18 or guide posts consist of a cylindrical disc 40 having a bearing side wall 41 and secured on an eccentric connecting rod 2. The connecting rod is a fastener extending coextensively with respect to the cylindrical side wall 41 and offset from a central axis of the disc 40 to provide an eccentric adjustment of the disc to adjust the spacing thereof relative to its associated side edge of the door opening, as illustrated by phantom lines 43 in FIG. 7. The disc 40 is preferably, but not exclusively, constructed as a solid nylon disc and which is secured to a respective base plate 44 by the connecting rod 42. The base plate provides for attachment to the floor surface 19.

Referring again to FIG. 3, it can be seen that the seal 45 is secured along a peripheral portion of the inner wall 46 of the door panel. The seal 45 is comprised of the resilient gasket secured along opposed side edges and a top edge of the inner wall 46 of the door panel 15 by connectors 47 which are constructed of plastics material, which is substantially non-thermally conductive and attached to the casing of the door panel. A flexible seal 48 is secured along a lower edge of the inner wall 46 by a further connector 49 of plastics material. The flexible seal 48 engages with the floor surface 19 to form a seal between the gasket or seal 45 disposed along adjacent vertical edges of the door panel. As the door panel is displaced against the door opening 14 the seal 45 is compressed about the outer surface or outer plane 38 of the door frame 39. The door panel 15 is comprised of a metal casing 50 having an insulated core 51.

Figure 6:
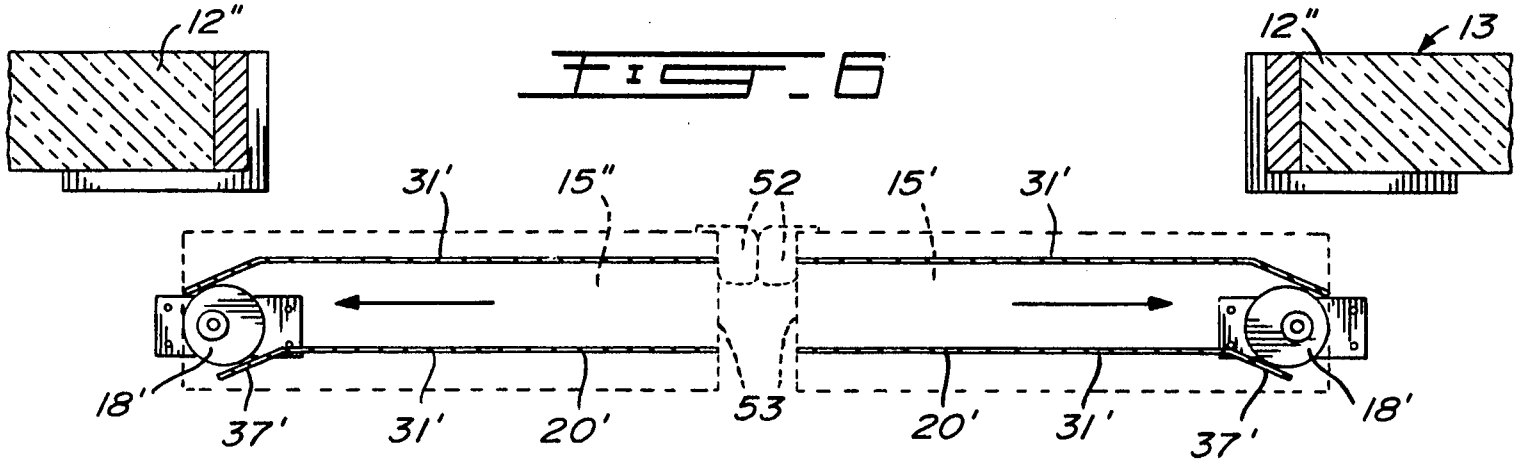
FIG. 6 is a section view similar to FIGS. 4 and 5 but showing a section sliding door with right and left side displacement door panels.

In FIG. 6 there is shown a door panel 15 divided in two sections 15' and 15'' each of which are displaced against an opposed front wall section 12' and 12'' of a refrigeration housing 13. As these door panel sections are moved outwardly on a respective support guide rail (not shown), they are caused to move outwardly from the surface of the front wall by the rail and the opposed angulated end sections 37' of the channel guide walls 31' in their lower edge. With such an arrangement it is not required to have an angulated wall section at the inlet end 33' of the door panel sections, as these panel sections would be arrested by stop means in the support rail 11 (not shown), but obvious to a person skilled in the art. Accordingly, the guide bearing 18' on each side of the door opening would still be engaged within the lower rails 20' adjacent the inlet end thereof. Suitable seals 52 would abuttingly engage at the opposed vertical free ends 53 of the door panel sections 15' and 15''. A suitable locking door handle mechanism would be provided to interlock the door panel sections together.

Referring now more specifically to FIGS. 8 to 13, there will be described the construction of the reinforced door frame 39 which is secured about the door opening 14 of the refrigeration housing. This door frame is not limited to door openings of this type of refrigeration housings, and may be secured to a door opening of all types of refrigeration housing, and preferably those wherein a hingeable door panel is secured to the frame so as to be able to withstand the load of the door which is connected thereto. As can be seen from FIGS. 8 and 9, the reinforced door frame 39 is comprised of an L-shaped metal extruded angle member 60, herein an aluminum extrusion, which is formed to define an outer angle frame section 61 and a transverse frame section 62. The angle member is extruded with an elongated channel 63 formed in the outer surface 38 thereof and spaced closely to the intersecting corner of the transverse frame sections 62. The channel defines two cavities 64 for receiving a resistive heating wire 64' therein. A cover strip 65 is securable in the cavity 63 to conceal same. The resistive elements 64' heat the extruded angle member 50 in the area which abuts with the door seal to prevent the formation of condensation and icing.

The extruded angle member 50 is secured to the reinforced vertical side edges of the opening formed by the edges of insulating panels 67 from which the refrigeration housing is constructed. A top door panel 68 is also secured between a top portion of exposed vertical extruded angle members 60 to strengthen their interconnection. The top door panel is also reinforced along the opposed vertical side edges 69 thereof. The reinforcements comprises; L-shaped metal bracket pieces 70 secured between a side and frontal edge section 71 and 72, respectively, of the side wall panel 67 and top door panel 68. A wooden board 73 is secured along the side edges 71 and 69 of the side wall panel and top wall panel respectively over the bracket pieces 70.

Figure 9:
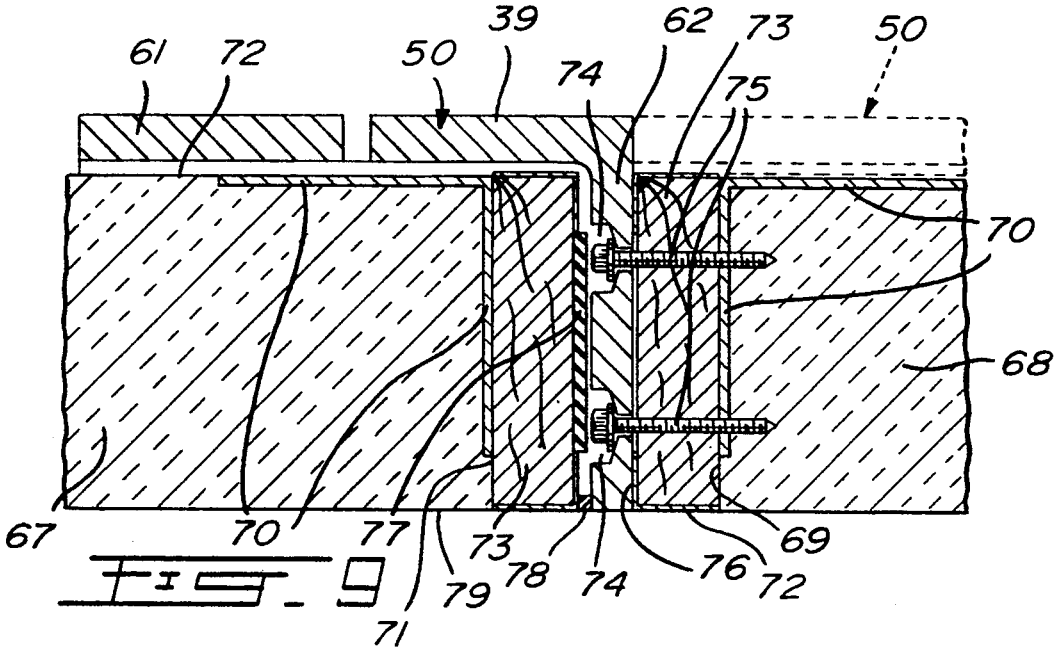
FIG. 9 is a section view along section lines A—A of FIG. 1, showing the peripheral construction of the door frame above the door opening and specifically the connection of an L-shaped metal extruded angle member with a top panel over the door opening and its relationship with the side panels of the refrigeration housing.

With reference to FIG. 9, the assembly of the reinforced door frame will now be described. As can be seen the transverse frame section 62 of the extruded angle member 50 is provided with screw head locating cavities 74 for receiving fasteners 75 therein which extends through the wooden board 23 of the top door panel 68 and into the bracket piece 70 to secure the angle member. An outer metal sheeting 76 covers the wooden board forming the edge of the panel, and this sheeting is the same as that extending over the panels. The fasteners 75 are not secured solely within the wooden board 73 as with the prior art structures, but extends thereacross in the metal bracket 70. After the top door panel 68 has been assembled with the extruded angle member 50 on each side thereof, this strengthened assembly of opposed parallel extruded angle members 50 is placed within the door opening and the outer frame section 61 as well as the transverse frame section 62 are secured to the angle bracket 70 extending in the front wall and side wall of the opening. The transverse frame section 62 is again secured through the board 73 within the side edge of the side wall panel 67. A strip of thermally nonconductive material 77 may be positioned over the side edge of the door opening form a barrier between the transverse frame section 62 of the angle member 60 and the side wall panel 67. A silicone seal 78 is then applied to seal the slot between the inner transverse frame 62 and inner wall 79 of the side wall panel and top door panel. Another angle member 50 is also secured to the lower side and frontal edge section of the top door panel, as shown in FIG. 3, and constitutes a nonbearing angle member, as there is no load secured thereto.

Figure 8:
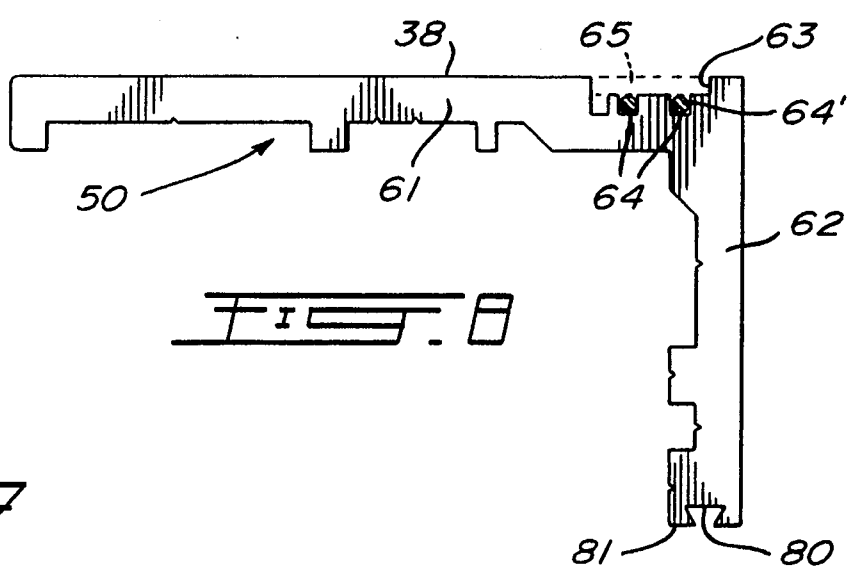
FIG. 8 is an end view of the L-shaped metal extruded angle member used in the door frame.
Figure 10A:
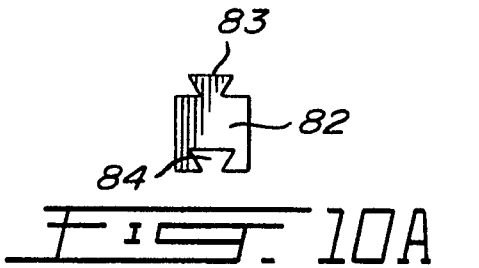
FIGS. 10A and 10B are end views showing the configuration of extension. Pieces of the angle member.
Figure 10B:
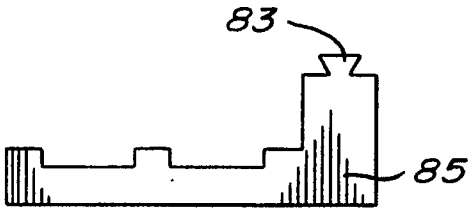

As shown in FIG. 8 the transverse frame section 62 may be provided with a connecting cavity 80 in an end edge 81 thereof for connecting extension pieces thereto to fit frames of different widths. FIGS. 10A and 10B illustrate a few of these extension pieces. In FIG. 10A the extension piece 82 is provided with a dovetail connector 83 to connect in the cavity 80 and to extend the length of the transverse frame section 62 to fit a door opening having a wider side edge. This extension section 82 may also be provided with a further connecting cavity 84 to receive an inner angle frame section 85 as shown in FIG. 10B. The inner angle frame section 85 forms a U-shape angle member to extend over the inner side edge portion of the door opening, if desired. It is also provided with a dovetail connector 83 for slide fit directly within the slide connecting cavity 80 or 84.

Figure 13:
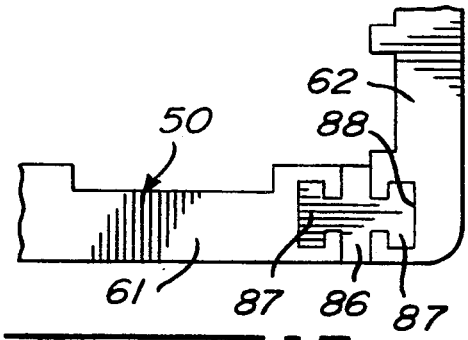
FIG. 13 is an another embodiment of the metal extruded angle member showing a thermal seal incorporated therewith.
Figure 4:
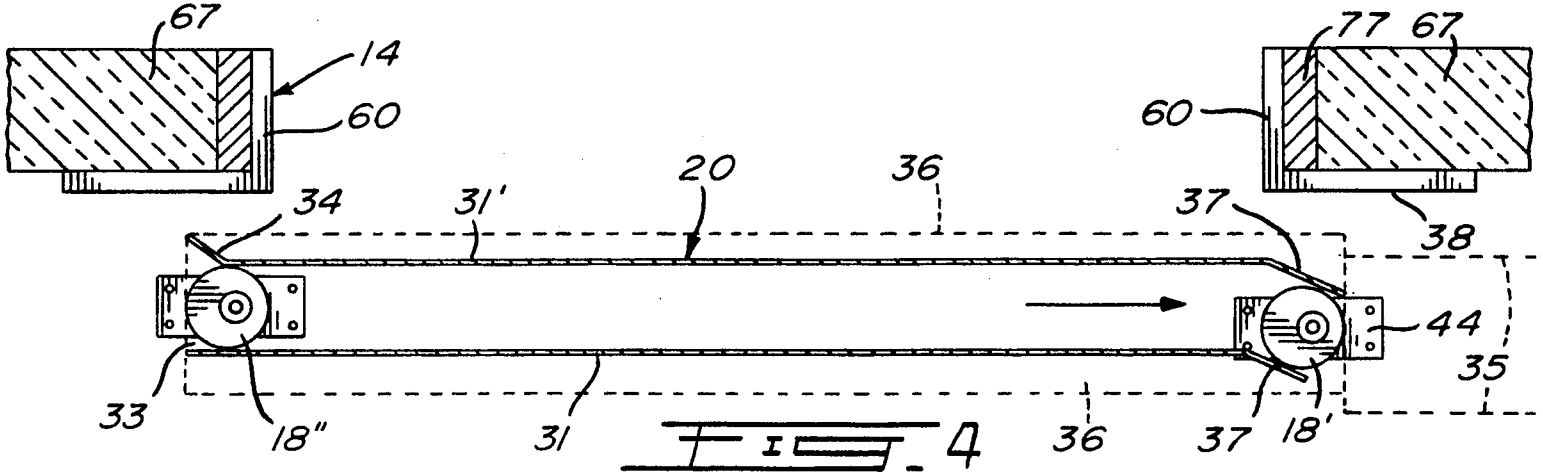
FIGS. 4 and 5 are section views showing the construction of the guide rail and its relationship with the guide posts for right and left side sliding doors.
Figure 5:
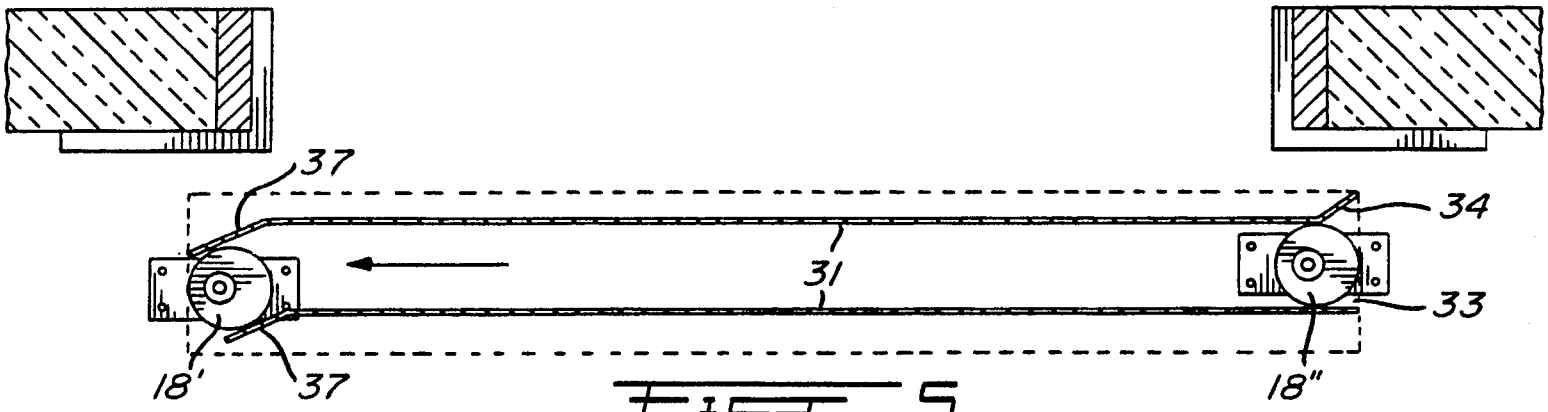

FIG. 13 illustrates another embodiment of the extruded angle member 60 and, as herein shown, a thermal seal connector interconnects transverse frame section 62 with the outer frame section 61. This thermal seal connector 86 provides a nonconductive barrier for the transverse frame section 62 which is in contact with the refrigeration space and the outer frame section 61 which is exposed to outside air. The connector 86 herein shown is provided with opposed flange sections 87 for sliding fit in opposed connecting cavities 88 of the outer and transverse frame section 61 and 62, respectively.

Figure 12A:
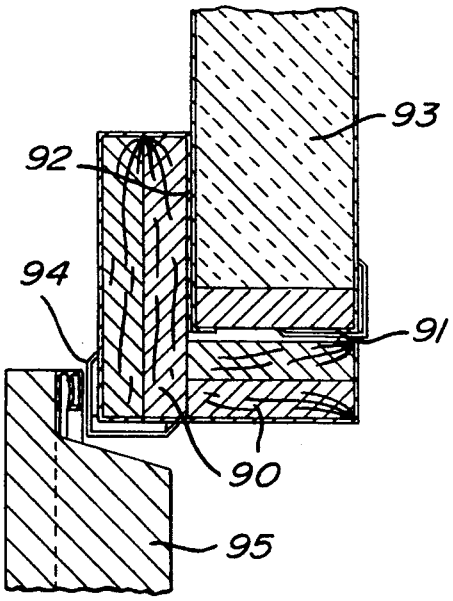
FIG. 12A (PRIOR ART)
FIGS. 12A and 12B are section views showing the construction of prior art refrigeration having door frames.
Figure 12B:
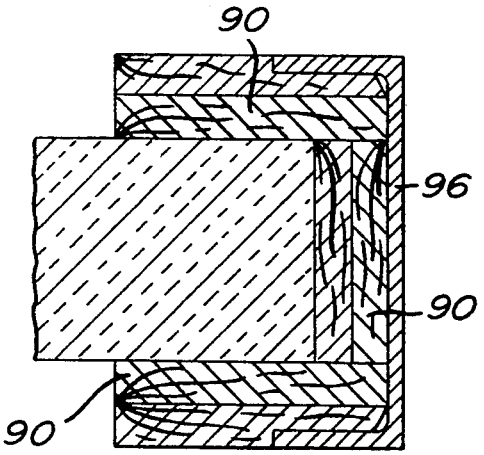
FIG. 12B (PRIOR ART)

The advantage of the reinforced door frame construction of the present invention is apparent when analyzing frame constructions of the prior art illustrated in FIGS. 12A and 12B. In the prior art the door openings are reinforced by plywood sheeting 90 extending over the inner edge 91 of the opening and the side edge 92 of the front wall 93. The fasteners for the hinge 94 of the hinge door 95 are secured directly within the plywood sheeting 90 and are intended to support the load of the door 95. It has been found that with such construction the fasteners eventually become undone and the reinforced plywood damaged making it difficult to repair. FIG. 12B shows a similar arrangement, but wherein a metal extrusion 96 is secured to the plywood pieces 90. Again, the fasteners extend solely within the plywood and eventually the screw fasteners become undone. The present invention obviates this disadvantage by providing inner reinforcement brackets spaced inwardly from the reinforced wooden boards so that the screw fasteners are engaged by self-tapping screws that penetrate the wooden board and into the metal brackets. The opposed extruded vertical frame members are also held in opposed rigid vertical parallel planes by the top door panel which resists bending moments of the vertical extruded members due to the load on one of the side frame by the attachment of a hinged door.

It is within the ambit of the present invention to cover any obvious modifications of the preferred examples of the invention described herein, provided such modifications fall within the scope of the appended claims.

I claim:

1. A slidable door displaceable on a top support rail from a closed position over a door opening to an open position to one side of said door opening, said slidable door comprising a rectangular door panel having door support means in a top edge thereof for displaceable support engagement with said top support rail, guide means provided in a lower edge of said door panel, spaced bearing means secured at predetermined locations adjacent a bottom edge of said door opening and disposed for engagement by said guide means, said guide means having door urging means to displace said door panel adjacent a frame of said door opening to close said door opening, said top support rail being a straight rail secured at an angle with respect to a vertical surface plane of said door opening so that when said door panel is in front of the door opening it closes said opening, and when displaced to said open position to one side of said door opening it is positioned outwardly of said plane of said door opening by said support means to which a top edge of said door is displaceably attached and said guide means to which a lower edge of said door is guidingly engaged, said guide means being a guide channel in said lower edge of said door panel, said channel having opposed parallel guide walls, said guide channel having an inlet end for receiving said spaced bearing means, an inner one of said guide walls having an outwardly angulated end section at said inlet end extending toward said door opening to frictionally engage with a first bearing means to cause said door panel to be urged closer to said door opening, said bearing means being constituted by a first and second guide post having a bearing surface and adjustably secured on an eccentric connection in a floor adjacent a respective one of opposed side edges of said door opening, said bearing surface being a cylindrical side wall of said guide post.

2. A slidable door as claimed in claim 1 wherein said door is a sealed door, there further being provided a seal between said door and said door opening.

3. A slidable door as claimed in claim 1 wherein said eccentric connection is a fastener rod extending coextensively with respect to said cylindrical side wall of said guide post and offset from a central axis of said guide post to provide eccentric displacement of said side wall to adjust a spacing of said door relative to its associated side edge of said door opening.

4. A slidable door as claimed in claim 3 wherein said guide posts are solid cylindrical nylon discs secured to a base plate for securement to said floor surface.

5. A slidable door as claimed in claim 1 wherein said guide channel is an extruded aluminum U-shaped channel having a base wall and said opposed parallel guide walls, said base wall being connected to a straight lower edge of said door panel.

6. A slidable door as claimed in claim 1 wherein said seal is secured along a peripheral portion of said door panel on an inner surface of said door panel, said seal being comprised of a resilient gasket secured along opposed side edges and a top edge of said door panel inner surface by connectors of thermally non-conductive material secured to said door panel, and a flexible seal secured along a lower edge of said door panel and in engagement with said floor surface.

7. A slidable door as claimed in claim 6 wherein said slidable door is a door for a refrigeration housing, said door having an insulating core and a metal casing, said metal casing being insulated from said frame of said door opening by said gasket and flexible seal secured by said connectors of thermally nonconductive material.

8. A slidable door as claimed in claim 1 wherein said top support rail is a roller bearing suspension track adjustably secured to a frame wall of said housing, said door support means being at least two adjustable wheel carriages secured spaced apart along said top edge of said door panel and engaged for displacement within said suspension track.

9. A slidable door as claimed in claim 1 wherein said frame of said door opening is comprised of an L-shaped metal extruded angle member secured to reinforce vertical side and frontal edge sections of opposed side edge of a side wall of said door opening, a reinforcing top door panel secured between opposed vertical L-shaped metal extruded members in a top section of said door opening, and a further non-bearing extruded angle member secured to a lower side and frontal edge section of said top door panel, said top door panel and side wall of said door opening having reinforcement means in connecting side edges thereof for receiving fasteners securing said extruded angle member extending on said opposed side edges of said door opening, said top door panel reinforcing said opposed vertical L-shaped metal extruded members whereby to provide for the support of the load of a door secured to at least one of said opposed vertical extruded members, said reinforcement means being comprised of L-shaped metal bracket pieces secured between a side and frontal edge section of said side wall and top door panel, and a wooden board secured over said metal bracket pieces along said side edges of said door opening and top door panel and a lower edge of said top door panel.

10. A reinforced door frame for a door opening of a refrigeration housing, said door frame comprising an L-shaped metal extruded angle member secured to reinforce vertical side edges of a door opening provided in a side wall of said housing, a top reinforcing door panel secured between said opposed L-shaped metal extruded angle members in a top section thereof, a non-bearing extruded angle member secured to a lower side and frontal edge section of said top door panel, said top door panel and side wall of said door opening having reinforcement means in connecting side edges of said angle members for receiving fasteners securing said extruded angle member extending on said opposed side edges of said door opening, said top door panel reinforcing said opposed vertical L-shaped metal extruded members whereby to provide for the support of the load of a door secured to at least one of said opposed vertical extruded members, said reinforcement means being comprised of L-shaped metal bracket pieces secured between a side and frontal edge section of said side wall and top door panel, and a wooden board secured over said metal bracket pieces along said side edges of said door opening and top door panel and a lower edge of said top door panel.

11. A reinforced refrigeration housing door frame as claimed in claim 10 wherein said L-shaped metal extruded angle member defines an outer angled frame section and a transverse frame section, screw head locating cavities in an inner face of said transverse frame section for securing said opposed extruded members to said top door panel, said fasteners extending through said wooden board and bracket pieces, said top door panel being secured to said opposed angle members prior to securing said opposed angle members to said vertical side edges of said door opening.

12. A reinforced refrigeration housing door frame as claimed in claim 11 wherein said transverse frame section is provided with a connecting cavity in an end edge thereof for connecting an extension piece to said transverse frame section.

13. A reinforced refrigeration housing door frame as claimed in claim 12 wherein said extension piece is an L-shaped piece defining an inner angled frame section to extend over an inner side edge of said door opening.

14. A reinforced refrigeration housing door frame as claimed in claim 11 wherein there is further provided an elongated channel in an outer face of said outer elongated frame section and spaced closely to an intersection edge with said transverse frame section, said channel receiving a resistive heating wire therein, and a cover strip securable to conceal said channel.

15. A reinforced refrigeration housing door frame as claimed in claim 10 wherein said metal extruded angle member is an aluminum extruded member.

* * * * *